US007396294B2

(12) United States Patent
Consiglio

(10) Patent No.: US 7,396,294 B2
(45) Date of Patent: Jul. 8, 2008

(54) IMPACT FORCE DAMPENING SYSTEM FOR USE WITH A GOLF PUTTER HEAD

(76) Inventor: Joseph Consiglio, 105 Saw Timber Dr., Hilton Head Island, SC (US) 29926

( * ) Notice: Subject to any disclaimer, the term of this patent is extended or adjusted under 35 U.S.C. 154(b) by 241 days.

(21) Appl. No.: 11/297,188

(22) Filed: Dec. 8, 2005

(65) Prior Publication Data

US 2007/0135230 A1 Jun. 14, 2007

(51) Int. Cl.
*A63B 53/04* (2006.01)

(52) U.S. Cl. ..... 473/332; 473/340

(58) Field of Classification Search ..... None
See application file for complete search history.

(56) References Cited

U.S. PATENT DOCUMENTS

| | | | | |
|---|---|---|---|---|
| 3,917,277 | A * | 11/1975 | Beck et al. | 473/244 |
| 4,422,638 | A | 12/1983 | Tucker | |
| 5,458,332 | A | 10/1995 | Fisher | |
| 5,489,097 | A * | 2/1996 | Simmons | 473/326 |
| 5,620,381 | A | 4/1997 | Spalding | |
| 5,643,111 | A | 7/1997 | Igarashi | |
| 5,718,643 | A | 2/1998 | Wright et al. | |
| 5,820,481 | A | 10/1998 | Raudman | |
| 6,200,226 | B1 | 3/2001 | Regan | |
| 6,450,903 | B1 | 9/2002 | Tate | |
| 6,729,972 | B2 | 5/2004 | Boord | |
| 6,743,117 | B2 | 6/2004 | Gilbert | |
| 6,921,343 | B2 | 7/2005 | Solheim | |
| 2005/0014574 | A1 * | 1/2005 | Sung | 473/329 |

FOREIGN PATENT DOCUMENTS

| | | | |
|---|---|---|---|
| JP | 62075225 | | 4/1987 |
| JP | 06339551 | | 12/1994 |
| JP | 08289950 | A * | 11/1996 |
| JP | 09239080 | | 9/1997 |
| JP | 11267255 | | 10/1999 |
| JP | 2000237363 | A * | 9/2000 |
| WO | WO-9832500 | | 7/1998 |
| WO | WO-9844997 | | 10/1998 |

* cited by examiner

*Primary Examiner*—Alvin A. Hunter, Jr.
(74) *Attorney, Agent, or Firm*—Gifford, Krass, Sprinkle, Anderson & Citkowski, P.C.

(57) ABSTRACT

A golf putter including an elongated handle terminating in a three-dimensional shaped putter head exhibiting a substantially smooth ball striking face. A vibration inducing component being mounted to first and second locations associated with a surface of the putter head and located opposite the ball striking face. Upon impacting a golf ball offset from a center line associated with the striking face, the vibration inducing components counteract twisting of the putter head, thereby increasing an effective surface area of the striking face creating a perpendicular travel direction of the ball relative to the putting face.

9 Claims, 3 Drawing Sheets

IMPACT FORCE DAMPENING SYSTEM FOR USE WITH A GOLF PUTTER HEAD

BACKGROUND OF THE INVENTION

1. Field of the Invention

The present invention relates generally to golfing clubs and, in particular, golf putters. More specifically, the present invention discloses a force dampening and redirection system for use with a golf putter head, incorporating a vibration-inducing component and which, in operation, increases an effective "sweet spot", this historically being the location of center of gravity of the golf club head and which results in straight and maximum travel of the golf ball, associated with the putter ball striking face providing straight directional travel of a golf ball.

2. Description of the Prior Art

The prior art is well documented with examples of golf club putter devices. A major objective of such devices is the ability to transfer, in a substantially lineal and consistent fashion, forces of impact associated with the forward travel of the putter head against a golf ball during a putting stroke.

U.S. Pat. No. 5,620,381, issued to Spalding, teaches a putter incorporating a plurality of fine spring wires distributed along its lengthwise extending face and including an angled leg portion, which extends upward and outward away from the initial leg portion. As the putter is swung, the angled leg portions spring inward and then upward and outward due to contact with the golf ball. This spring action simultaneously imparts both a forward and topspin motion to the golf ball, the professed objective being to impart a rolling motion (and as opposed to non-rotative and primarily "scooting" motion) as early on as possible during the putting stroke and in order to provide better direction and control of the ball.

U.S. Pat. No. 5,820,481, issued to Raudman, teaches an improved golf putter employing an elastomeric material between the putter face and body in order to dampen vibrations caused by impact of the moving putter face on the golf ball. Of relevant note, the vibrations are directed by the putter body configuration in such a way as to maximize the dampening function. In order to provide enhanced rolling motion to the struck ball, weighting is focused towards the bottom of the putter head. Angular design of the face, bottom and heel acts to decrease potential blade turf drag, enhancing the smooth feel of the club system.

U.S. Pat. No. 6,743,117, issued to Gilbert, discloses a golf club head having a substantially perimeter weighted club head, including the interposing of three inserts, including among them a striking face insert, a dampening insert, and a back insert. The dampening insert is preferably constructed of a lead alloy, and is interposed between the other inserts to provide for changes in club swing weight, as well as relief for vibration and acoustical variations. The striking face insert is further preferably made from a stainless steel alloy and the back insert from a carbon graphite. Gilbert further discloses the dampening insert being maneuvered into varied positions to effect a change in the specific gravity of each club head of a golf club set.

Another interesting example of a vibrational dampening putter is set forth in WO 98/32500, to Cobra Golf, and which teaches a cavity backed design with three piece construction. A club head body portion includes a strike face insert cavity for receiving a strike face insert, this further exhibiting a central cavity. An additional recess is formed within the strike face insert cavity and may receive a vibration dampening material. The sizes of the strike face insert cavity, vibration dampening insert recess and aperture are progressively varied in accordance with the particular golf club characteristics, in order to improve weight distribution and/or vibration dampening and to increase strike face surface area.

SUMMARY OF THE PRESENT INVENTION

The present invention discloses a golf putter device capable of increasing the "sweet spot" associated with the putter's ball striking face, and which results in the imparting of substantially perpendicular and lineal ball travel relative to the striking face. As defined previously, the "sweet spot" of a golf club head is traditionally its center of gravity and, upon striking a ball at this location upon the putter striking face, resultant ball travel is maximized as to both distance and straightness. The present invention utilizes vibration generating/redirecting components associated with the putter head, offsetting the twisting tendencies of the putter head from acting upon a golf ball contacted offset from a mass centerline associated with the putter head.

In a first embodiment, the putter head includes a semi-circular shaped and coiled spring securing at first and second ends to associated surface locations of the putter head arranged opposite the ball striking face. The spring contacting ends may further be encased within at least one elongated and interiorly hollowed closure secured to the putter head. The closure may likewise be semi-circular shaped or, in the instance of a pair of independent coiled portions, be provided as separate components.

In a further embodiment, the vibration inducing components are provided by tuning-fork shaped articles secured to each of first and second surface locations of the putter head arranged opposite the ball striking face. Either the miniaturized tuning forks or, alternatively, the spring contacting portions, can be provided in any of in-line, arcuate or angularly offset manner relative to the associated mounting surface of the putter head, and in order to adjust the desired degree of vibration induced dampening associated with a given off centerline location of the club head.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
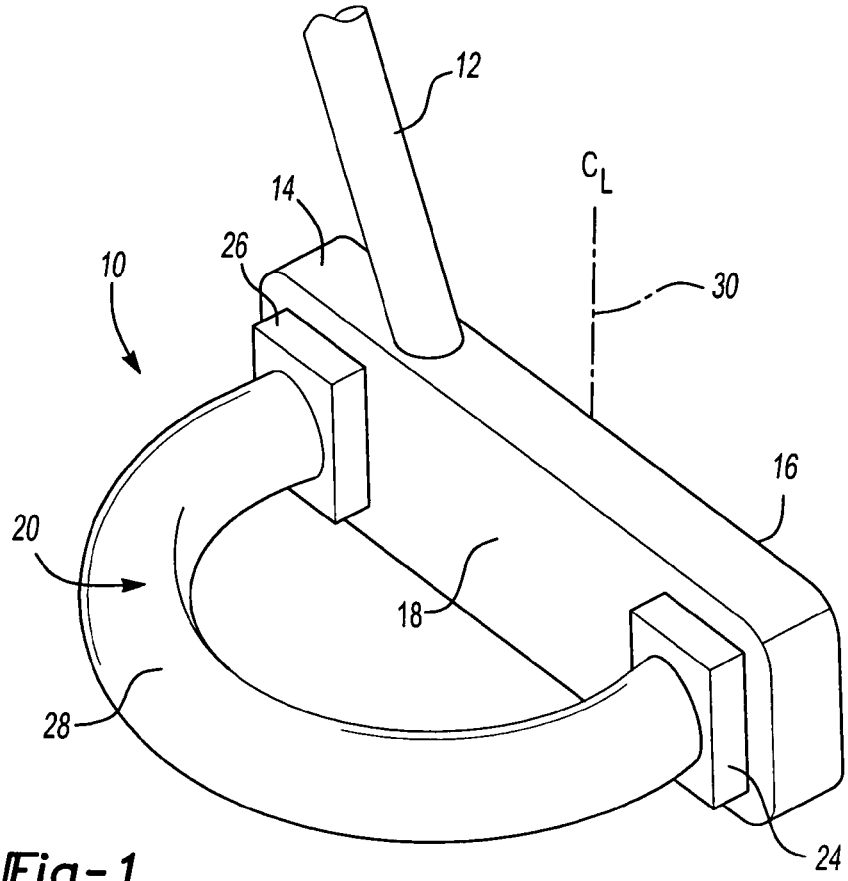
FIG. 1 is a perspective illustration of the golf putter exhibiting force-dampening features according to an embodiment of the present invention.

Referring now to FIG. 1, a perspective illustration is shown at 10 of a golf putter exhibiting impact force dampening and redirection characteristics according to a preferred embodiment of the present invention. In particular, the present invention utilizes vibration generating/redirecting components associated with the putter head, these acting to offset the twisting tendencies of the putter head about its associated center line, to thereby prevent an undesirable angle of direction being imparted upon a golf ball contacted outside of the ideal mass centerline associated with the putter head.

Referring again to FIG. 1, the putter includes an elongated handle 12 terminating in a three-dimensional shaped putter head 14. The putter head 14 is constructed of a wood, metallic or plasticized, such as in particular nylon, material (such material further being understood as capable of transferring the vibrationally induced component through the body of the putter head and to its front face) and typically exhibits a substantially rectangular shape in configuration with a substantially smooth front ball striking face 16 and an opposite rear face 18. It is also envisioned that the putter head 14 can adapt any other desired configuration within the ordinary skill of one in the relevant art.

A vibration inducing component according to the initial embodiment is generally illustrated at 20 and exhibits a semi-circular shaped coiled spring element (see at 22 in FIG. 2) and which is secured to first 24 and second 26 surface locations associated with the rear face 18 of the putter head 14. The surface mounting locations 24 and 26 are further evidenced in the illustrated embodiment by three-dimensional shaped supports, these interconnecting the ends of the vibration inducing and arcuate coil spring 22 with the body of the putter head 14. Beyond the manner of interconnecting the spring 22, as illustrated in FIG. 2, it is also understood that any other suitable structure can be employed within the scope of the invention for mechanically and vibrationally communicating the spring 22 (or other suitable vibration inducing component) with the putter striking surface 16.

Figure 2:
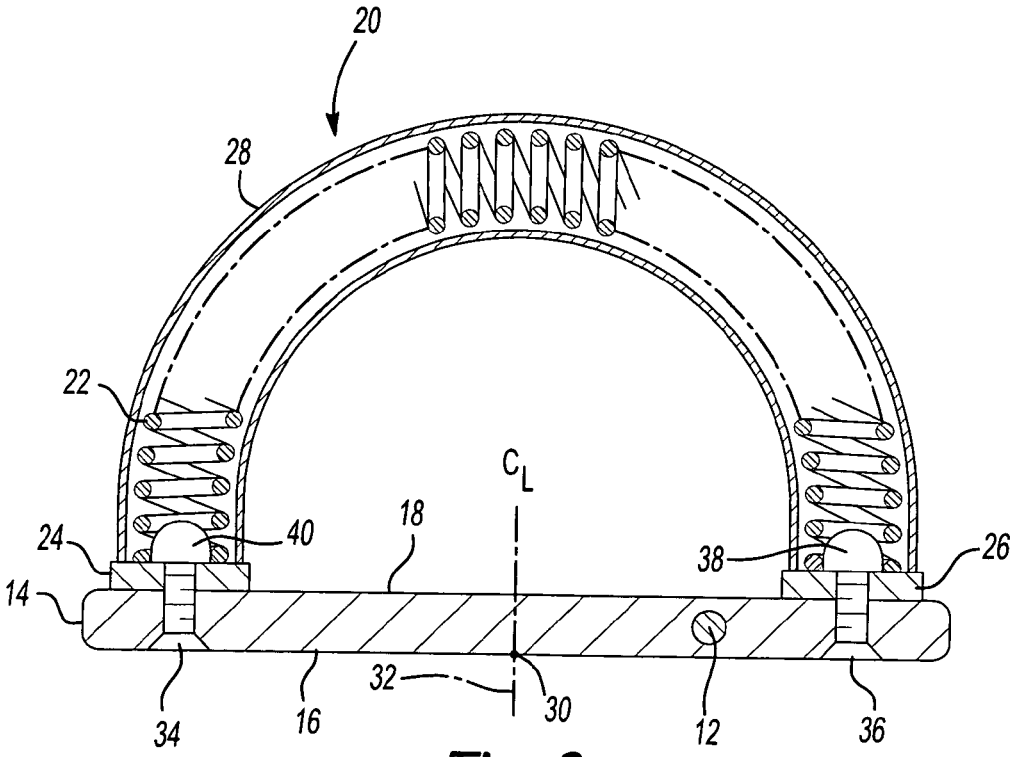
FIG. 2 is a plan cutaway view of the golf putter head and further illustrating the vibration inducing spring component associated with the embodiment of FIG. 1.

Also illustrated in FIGS. 1 and 2 is the provision of a likewise arcuate and elongated (interiorly hollowed) closure 28 secured to the support and enclosing the vibration inducing component. It is understood that the provision of a suitably configured enclosure 28 is optional and, as with the degree of tension and coil density 5 associated with the spring 22, may be modified to vary the vibrational inducing force applied to the front face 16 of the putter head 14.

Upon impacting a golf ball (not shown) along a center line (see at 30 in each of FIGS. 1 and 2) associated with the front striking face 16, this vertically intersecting a center of mass associated with the putter head 14, the golf ball is caused to travel in a substantially straight direction, corresponding with a perpendicular relative to the putting face 16 and as is referenced at 32 in FIG. 2.

The present invention is intended to address the inevitable non-linear (or more accurately the non-perpendicularly) extending travel of the golf ball, resulting from the striking motion of the putter head against the ball outside of the centerline "sweet spot". In this instance, the inevitable physical rotation of the putter head 14 causes it to rotate about its center of mass (again resulting from the combined physical effect of the putter head's mass and its connection location to the elongated handle 12), imparting an undesirable "push" or "pull" to the ball causing it to travel in a non-linear direction.

The vibration inducing component of the present invention operates to counteract this inevitable twisting of the putter head, through the creation of a vibrational inducing/offsetting component which acts upon the point of contact with a golf ball contacted by the putter head offset from either side of the centerline/center of mass. The mounting of the vibration inducing component, to either end of the putter rear face 18, results in the intensity of the vibrational created component increasing as a variable of the lateral distance from the centerline location 30, thereby increasing an effective surface area of the striking face by which a desired perpendicular travel direction of the ball relative to the putting face is maintained. The purpose of the vibrational inducing components is to collect and redirect the impact forces associated with a non-centerline striking of a golf ball by the putting face (not the creation or new or additional forces) to "correct" inevitable rotation of the putting head about its mass center and to again thereby increase the surface area (sweet spot) of the putter striking face achieving substantially perpendicular directed motion of the ball.

Additional features associated with the disclosed embodiment 10 include the provision of aligning and interiorly threaded apertures associated with the putter head 14 and each of the supports 24 and 26 (see in particular FIG. 2). A pair of mounting screws 34 and 36 secure the supports 24 and 26 to the edge locations of the forward ball striking face 16, whereas spring mounting knobs 38 and 40 (again FIG. 2) which structurally secure the spring and associated housing to the rear side of the putter head, thereby structurally and (vibrationally) interconnected the inducing component 22 through the putter head and across its front face 16.

As is illustrated in FIG. 2, the recesses defined in the forward facing surface of the putter head may be dovetailed to provide a flush end appearance to the screw heads, however it is further understood that any suitable means for securing the vibration inducing component to the desired locations of the putter head is also contemplated, such further including the provision of welding, adhesives or the like. It is also envisioned that, while the preferred embodiment contemplates the mounting locations of the semi-circular spring 22 as corresponding to the rear face of the putter head 14, it is further envisioned that the vibration inducing components can be mounted in alternate locations, provided that the required degree and direction of the vibrational generated force is established for acting upon the golf ball.

Figure 3:
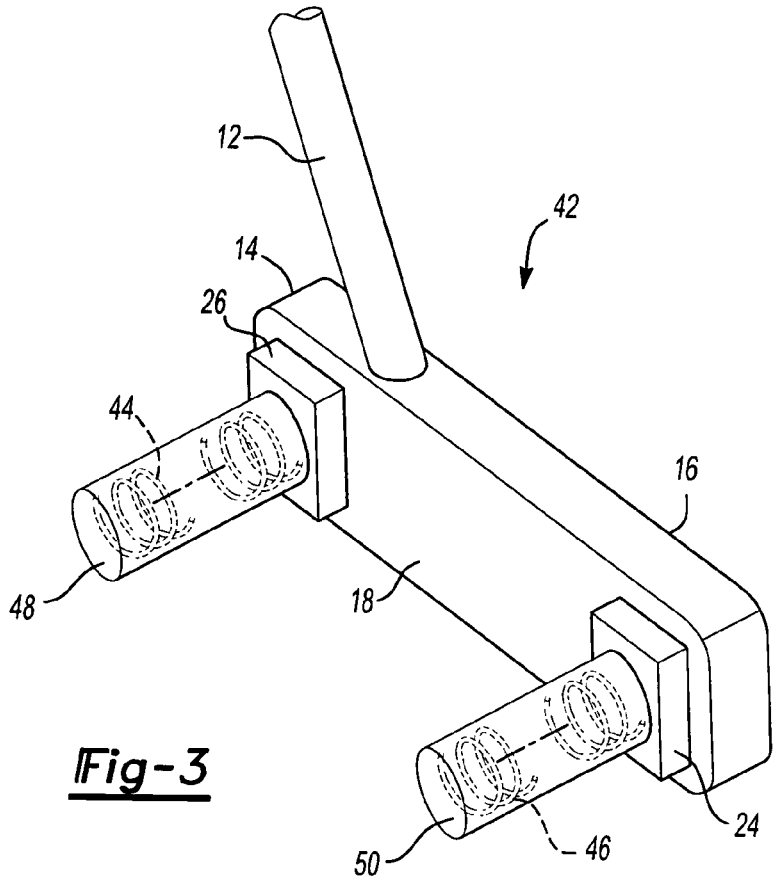
FIG. 3 is a perspective illustration of a golf putter head, and illustrating a pair of individual vibration inducing components secured to the putter head according to a further embodiment of the present invention.
Figure 4:
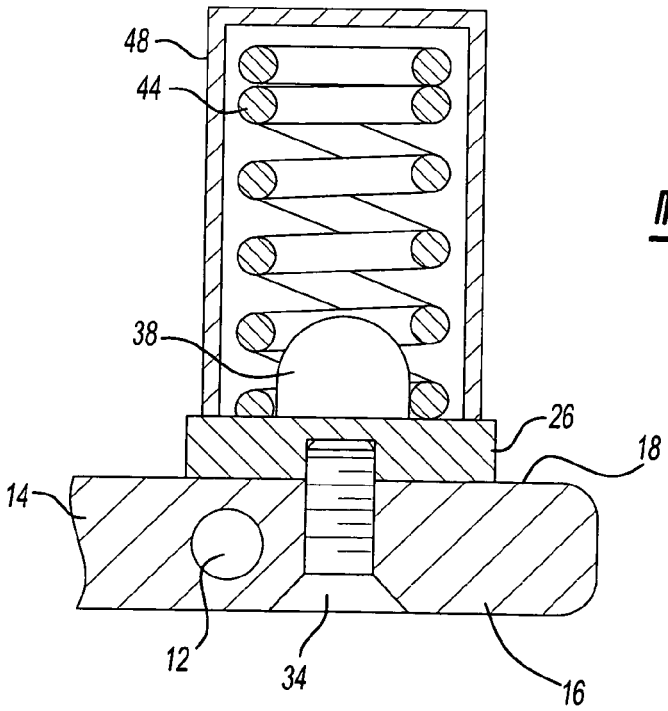
FIG. 4 is a cutaway view of a selected vibration-inducing component illustrated in FIG. 3.

Referring now to FIG. 3, a perspective illustration 42 of a golf putter head is shown according to a further embodiment. Common features associated with the putter handle and head are repeated from FIGS. 1 and 2, the embodiment 42 further including a pair of individual vibration inducing components in the form of individual and substantially linear (rearwardly) extending springs 44 and 46 secured to the putter head. As with the previously described embodiment 10, the springs 44 and 46 each secure to respective rearward mounted supports 24 and 26 in order to impart a desired compensating level of vibrationally induced and redirecting force. As is also referenced by the cutaway view of FIG. 4, each vibration-inducing component, illustrated as spring component 44, may also, and optionally, include an elongated and interiorly hollowed closure, such as illustrated at 48 for spring inducing component 44 as well as at 50 for spring inducing component 46.

Figure 5:
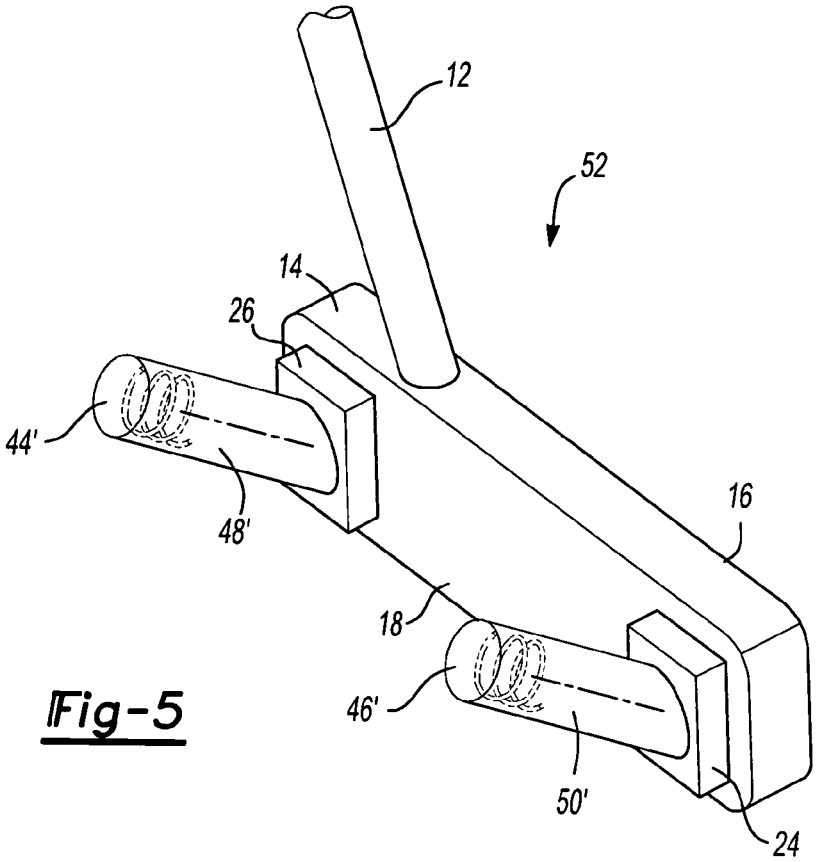
FIG. 5 is a perspective illustration of a golf putter head, similar to that illustrated in FIG. 3, and according to a still further embodiment exhibiting an angular orientation associated with each of the individually secured vibration inducing components.

FIG. 5 is a perspective illustration 52 of a golf putter head, similar to that illustrated in FIG. 3, and according to a still further embodiment. Of note, the embodiment of FIG. 5 exhibits an angular orientation associated with each of the individually secured vibration inducing components, i.e., vibrational inducing springs shown at 44' and 46' and including likewise angularly oriented enclosures 48' and 50', respectively. FIG. 5 illustrates the manner by which the vibration inducing and redirecting components can be arranged in any of arcuate, in-line or angular extending fashion as set forth in the preceding embodiments within the scope of the invention.

Figure 6:
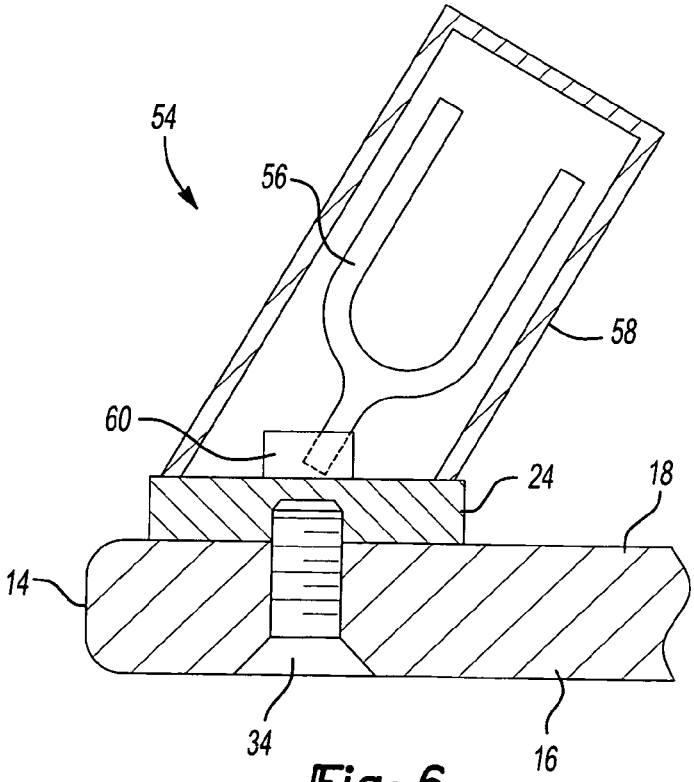
FIG. 6 is an illustration similar to that shown in FIG. 4, and showing a selected vibration inducing component according to a yet further embodiment according to the present invention.

Referring finally to FIG. 6, a sectional illustration 54 is shown of a selected vibrational inducing component according to a yet further embodiment and which illustrates a tuning-fork shaped article 56 secured to the selected surface locations of the putter head arranged opposite the ball striking face. The illustration of the tuning fork article stresses that any suitable vibration inducing article may be incorporated into the golf putter design within the scope of the invention.

As with the previously disclosed embodiments, the vibration inducing component 56 may, optionally, be enclosed by a suitable enclosure 58 and is in structural (and thereby vibrational) communication with the front face 16 of the putter head. Reference is further made to mounting base 60 for securing the tuning fork 56 (with or without separately secured enclosure 58) to the rear face secured support 24, and to thereby provide the desired vibrational inducing characteristics as previously described.

It is therefore evident that the present invention discloses a novel and useful golf putter design exhibiting a desired vibration inducing component, including again either a spring, tuning fork or other vibration generating element (including potentially at least one electronically powered and vibrationally inducing element). In the instance of spring inducing elements, both their respective length and wire diameter, as well as again number of coils, can be modified to provide a different range of vibrational input (or feel to the user) during the putting stroke. It is also envisioned that a single or plural number of springs can be utilized in any effective manner consistent with the teachings of the present disclosure.

Having described my invention, additional preferred embodiments will become apparent to those skilled in the art to which it pertains, and without deviating from the scope of the appended claims.

I claim:

1. A golf putter exhibiting impact force dampening and ball redirection characteristics upon impacting a golf ball, comprising:

an elongated handle terminating in a three-dimensional shaped putter head exhibiting a substantially smooth ball striking face; and at least one elongated and curved vibration inducing component mounted to and extending between first and second locations of said putterhead in structural communication with said ball striking face, wherein said at least one elongated and curved vibration inducing component comprising a coiled spring;

upon impacting a golf ball, said vibration inducing component counteracting twisting of said putter head symptomatic of a putter stroke through the collection and redirection of impact forces associated with a non-centerline striking of a golf ball along the length of the inducing component, thereby increasing an effective surface area of said striking face associated with straight travel of the ball.

2. The golf putter as described in claim 1, said coiled spring exhibiting a substantially semi-circular shape and securing to first and second surface locations of said putter head arranged opposite said ball striking face.

3. The golf putter as described in claim 1, said putter head further comprising at least one of a metallic, wood, and a plasticized material.

4. The golf putter as described in claim 3, said putter head further comprising an integral nylon striking surface.

5. The golf putter as described in claim 1, said putter head further comprising said vibration inducing component defining an elongated configuration arranged according to at least one of an in-line, arcuate and angularly offset manner relative to a mounting surface opposite said ball striking surface of said putter head.

6. A golf putter, comprising:

an elongated handle terminating in a three-dimensional shaped putter head exhibiting a substantially smooth ball striking face;

at least one vibration inducing component mounted to first and second locations associated with a surface of said putter head opposite said ball striking face;

said vibration inducing component further comprising a coiled spring, said coiled spring exhibiting a substantially semi-circular shape and securing to first and second surface locations of said putter head arranged opposite said ball striking face; and upon impacting a golf ball offset from a center line associated with said striking face, said vibration inducing component counteracting twisting of said putter head, thereby increasing an effective surface area of said striking face creating a perpendicular travel direction of the bail relative to said putting face.

7. The golf putter as described in claim 6, further comprising a pair of supports interconnecting said vibration inducing component to each of first and second locations associated with said putter head.

8. A golf putter exhibiting impact force dampening and ball redirection characteristics upon impacting a golf ball, comprising:

an elongated handle terminating in a three-dimensional shaped putter head exhibiting a substantially smooth ball striking face; and a vibration inducing component mounted to and extending between first and second locations of said putterhead in structural communication with said ball striking face, wherein said at least one elongated and curved vibration inducing component comprising a coiled spring;

at least one elongated and interiorly hollowed closure secured to said putter head and enclosing said vibration inducing component, aligning and interiorly threaded apertures being associated with said putter head and each of a pair of supports corresponding to said surface mounting locations, a pair of fasteners securing said supports and associated vibration inducing components to said putter head;

upon impacting a golf ball, said vibration inducing component counteracting twisting of said putter head symptomatic of a putter stroke through the collection and redirection of impact forces associated with a non-centerline striking of a golf ball along the length of the inducing component, thereby increasing an effective surface area of said striking face associated with straight travel of the ball.

9. A golf putter exhibiting impact force dampening and ball redirection characteristics upon impacting a golf ball, comprising:

an elongated handle terminating in a three-dimensional shaped putter head exhibiting a substantially smooth ball striking face; and at least one vibration inducing component mounted to and extending between first and second locations of said putterhead in structural communication with said ball striking face, wherein said at least one elongated and curved vibration inducing component comprising a coiled spring;

a pair of supports interconnecting said vibration inducing component to each of first and second locations associated with said putterhead, at least one elongated and interiorly hollowed closure secure to said support and enclosing said vibration inducing component; and aligning and interiorly threaded apertures associated with said putter head and each of said supports, a pair of fasteners securing said supports and associated vibration inducing components to said putter head;

upon impacting a golf ball, said vibration inducing component counteracting twisting of said putter head symptomatic of a putter stroke through the collection and redirection of impact forces associated with a non-centerline striking of a golf ball along the length of the inducing component, thereby increasing an effective surface area of said striking face associated with straight travel of the ball.

* * * * *